US005713083A

United States Patent [19]

King

[11] Patent Number: 5,713,083

[45] Date of Patent: Feb. 3, 1998

[54] THIN-WALLED PLASTIC HAT STRUCTURE

[76] Inventor: William L. King, 808 Anita Dr., Tehachapi, Calif. 93561

[21] Appl. No.: 785,866

[22] Filed: Jan. 21, 1997

[51] Int. Cl.[6] ..... A42B 3/14

[52] U.S. Cl. ..... 2/416; 2/181; 2/181.4; 2/181.6; 2/182.1; 2/182.2; 2/182.3

[58] Field of Search ..... 2/175.1, 175.4, 2/173.5, 181, 181.2, 181.4, 181.6, 181.8, 182.1, 182.2, 182.3, 182.5, 182.7, 416

[56] References Cited

U.S. PATENT DOCUMENTS

D. 102,400 12/1936 Sloan .
D. 118,432 1/1940 Lewis .
D. 123,638 11/1940 Perrin .
D. 138,796 9/1944 Zurfehr et al. .
D. 201,743 7/1965 Marchello .
D. 203,153 12/1965 Marchello .
3,015,103 1/1962 Zbikowski .
3,103,015 9/1963 Plastino .
4,198,710 4/1980 Lamb ..... 2/416
4,439,871 4/1984 Plastino .
5,493,735 2/1996 Rice .

*Primary Examiner*—Diana Biefeld
*Attorney, Agent, or Firm*—William W. Haefliger

[57] ABSTRACT

A one-piece, lightweight, molded plastic hat that comprises, in combination, a thin, molded plastic sheet forming a hat wall dome having an inner side, the sheet at the dome everywhere having thickness less than 3/16 inch; the sheet at the dome forming a corrugation having a local portion defining a U-shaped cross section; and a local plastic reinforcement sub-sheet formed to have U-shaped cross section matching that of the dome local portion, the sub-sheet fitting and adhesively bonded to the dome sheet local portion at the inner side of the hat dome.

7 Claims, 8 Drawing Sheets

THIN-WALLED PLASTIC HAT STRUCTURE

BACKGROUND OF THE INVENTION

This invention relates to a lightweight, protective plastic hat structure; and more particularly, to a thin-walled, plastic hat that is easily molded and reinforced, and is also provided with plastic carrier structure for a supporting harness, in such a way that the harness is easily removable, as for cleaning or adjustment.

There is need for lightweight, protective plastic hats having the unusually advantageous structures and modes of utility as are now provided by the present invention.

SUMMARY OF THE INVENTION

It is a major object of the invention to provide an improved, thin-walled, lightweight plastic hat meeting the above need. Basically, the improved hat comprises:

a) a thin, molded plastic sheet forming a hat wall dome having an inner side, the sheet at the dome substantially everywhere having thickness less than 3/16 inch, b) the sheet at the dome forming a corrugation having a local portion defining a U-shaped cross section, c) and a local plastic reinforcement sub-sheet formed to have a U-shaped cross section matching that of the dome local portion, the sub-sheet fitting and adhesively bonded to the dome sheet local portion at the inner side of the hat dome.

A highly protective brim-type hat may thereby be easily formed from such thin, molded plastic material and locally reinforced, as referred to.

It is another object of the invention to provide a plastic hat wherein a dome local portion has lengthwise elongated extent and the U-shaped cross section is defined everywhere along the elongated extent; and also wherein the reinforcement sub-sheet has lengthwise elongated extent and has U-shaped cross section matching that of the dome local portion everywhere along the elongated extent thereof.

Typically, the reinforcement sub-sheet has thickness less than ¼ inch, as well as length between 1 inch and 4 inches.

A further object is to provide:

d) the hat dome wall having a lower looping portion with an inner side for reception over a wearer's head, the lower looping portion also consisting of molded plastic material, e) multiple plastic thin-walled carriers affixed to the inner side of the lower looping portion, f) the carriers each having thin sheet configuration, g) the carriers and the hat dome wall forming slots for retention of head-supporting harness structure.

As will appear, the plastic carriers have thin wall thickness, and form grooves which define the slots, each groove having length and width substantially greater than groove thickness. Harness structure, including plastic inserts, are slidably receivable in such slots, so as to enable easy removal of the harness for adjustment or cleaning.

Further, the carriers advantageously define wings that are spaced apart, and the inserts define wings retained by the carrier wings. The inserts have tongues received between the carrier wings and that carry harness band structure; and the inserts also consist of plastic material and have frictionally slidable engagement with the carriers.

These and other objects and advantages of the invention, as well as the details of an illustrative embodiment, will be more fully understood from the following specification and drawings, in which:

DRAWING DESCRIPTION

DETAILED DESCRIPTION

Figure 1:
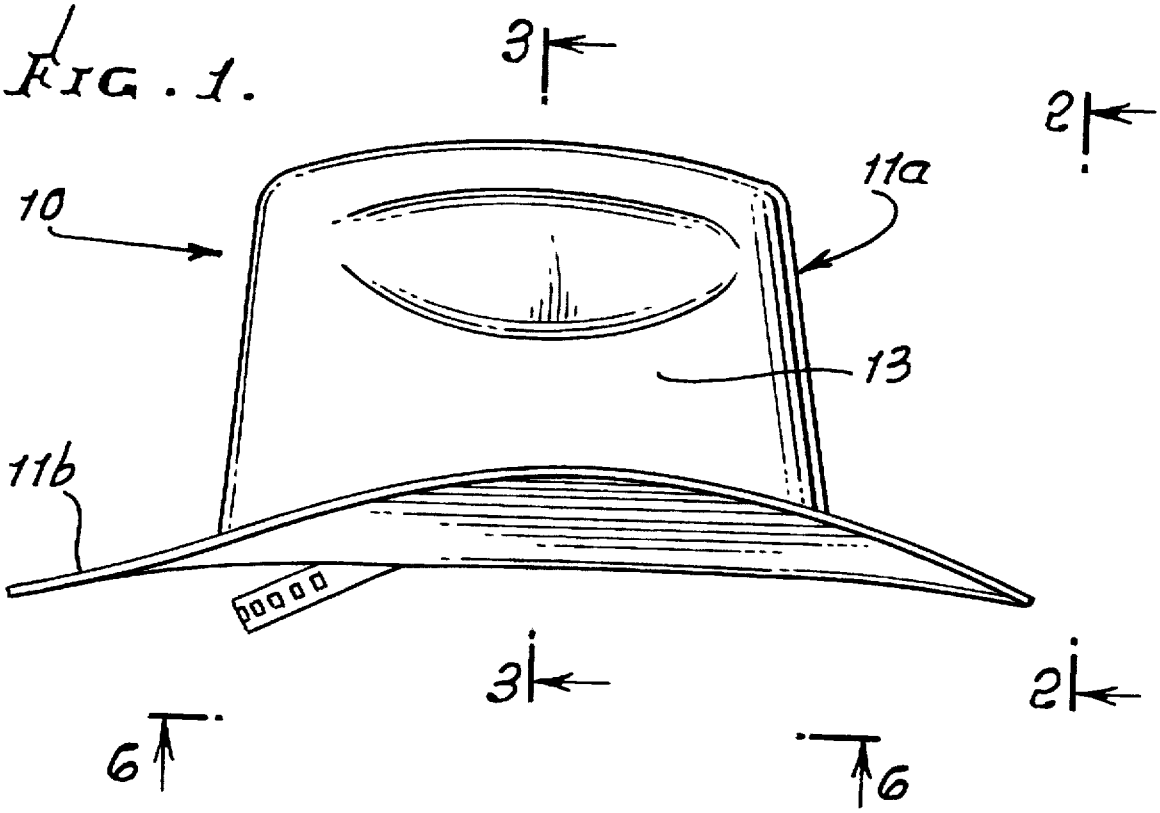
FIG. 1 is a side elevation of a molded plastic hat incorporating the invention.
Figure 2:
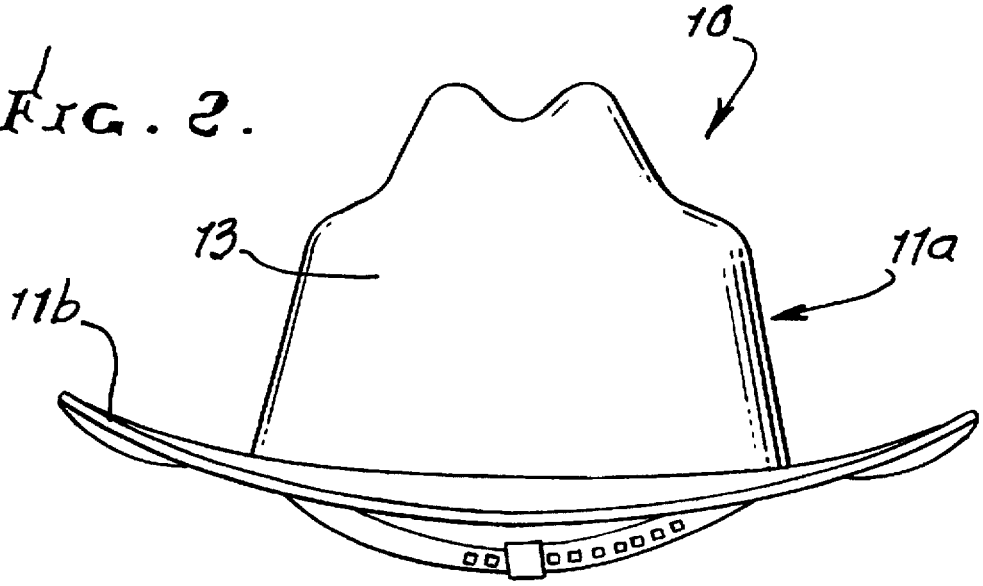
FIG. 2 is a front elevation taken on lines 2—2 of FIG. 1.
Figure 3:
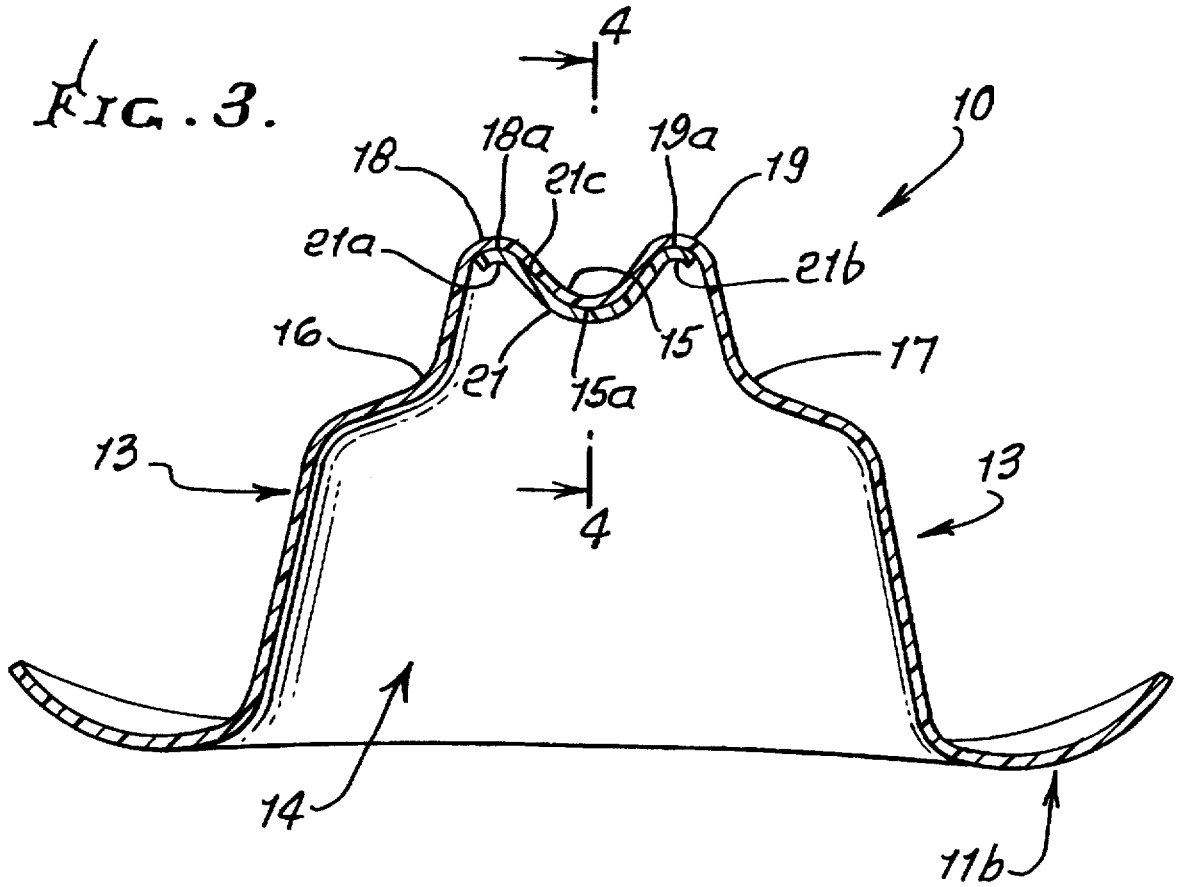
FIG. 3 is an enlarged vertical section taken on lines 3—3 of FIG. 1.

In the drawings, a one-piece, molded plastic hat 10 has a dome-shaped portion **11*a* and a brim portion 11*b*** surrounding lower extent of the dome portion. Thickness of each such portion is less than 3/16 inch and is preferably about ⅛ inch throughout the hat. The plastic composition is such that the hat dome portion is stiff and substantially unbendable. The brim portion is also relatively stiff and only slightly bendable. Typical plastic compositions are styrene, and reinforcing fibers in a plastic matrix. The dome portion and brim portion are both sheet-like.

The sheet-like dome portion has a side wall 13 extending upright about hat interior 14. The top of the dome forms convoluted corrugations, including an uppermost U-shaped portion 15, which is lengthwise forwardly elongated and downwardly convex, two side portions 16 and 17 that are downwardly and inwardly convex, and two upwardly convex connector portions 18 and 19. Portion 18 connects 15 and 16, and portion 19 connects 15 and 17. Portions 16–19 are also forwardly elongated. The overall configuration of the hat dome portion 10 resembles that of a Stetson hat. Other hat shapes are also contemplated.

A problem of providing adequate strength against breakage (as during impact) exists where the hat is uniformly thin, as shown, to have lightweight, molded construction, and where the hat has required overall stiffness and strength. This problem is found to be acute at the uppermost portion 15, and the sharply reversely curved adjacent portions 18 and 19.

In accordance with one aspect of the invention, internal reinforcement is provided by a local plastic sub-sheet 21 molded to have U-shaped transverse cross section matching that of the lower side **15*a* of the dome-shaped local portion 15. Forwardly elongated, transversely spaced side edge portions 21*a* and 21*b* of the sub-sheet are reversely curved to interfit the lower sides 18*a* and 19*a* of reversely curved downwardly concave portions 18 and 19; and the upper side 21*c* of 21 is adhesively bonded to lower sides 15*a*, 18*a* and 19*a***.

Therefore, elongated, disked sub-sheet 21 is concealed at the inner side of 14 of the hat dome; and it reinforces elements 15, 18, and 19, which have the extreme molded curvatures as shown, preventing fracture of the hat at its dome, as could otherwise occur, as for example if the hat is dropped, or if a "penetrating" object impacts the hat top or crown. Sub-sheet 21 is forwardly elongated in the direction of arrows 24, as seen in FIGS. 4 and 5, as in the direction of forward elongation of dome portions 15, 18, and 19.

The wall thickness of the sub-sheet 21 is substantially uniform, can be greater than the thickness of hat portion 15, and is less than ¼ inch. Typically, the length of the sub-sheet 21 lies between 1 and 4 inches.

Figure 4:
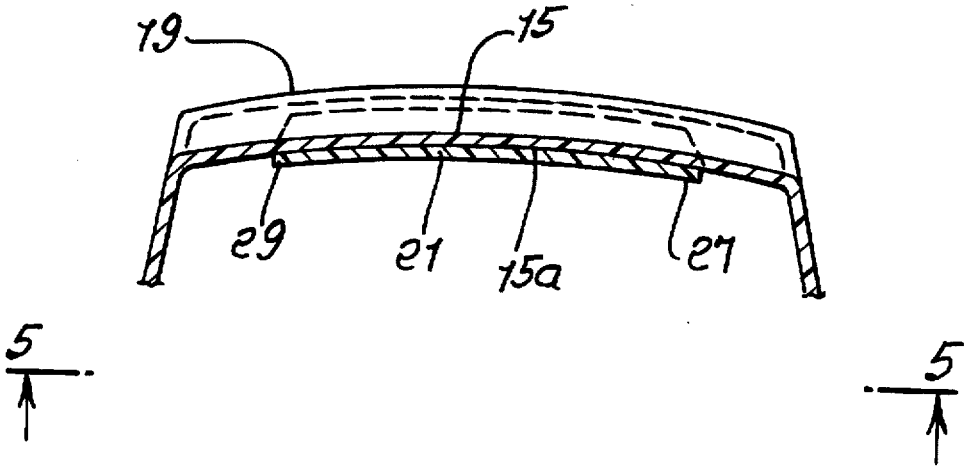
FIG. 4 is a further enlarged vertical section taken on lines 4—4 of FIG. 3.
Figure 5:
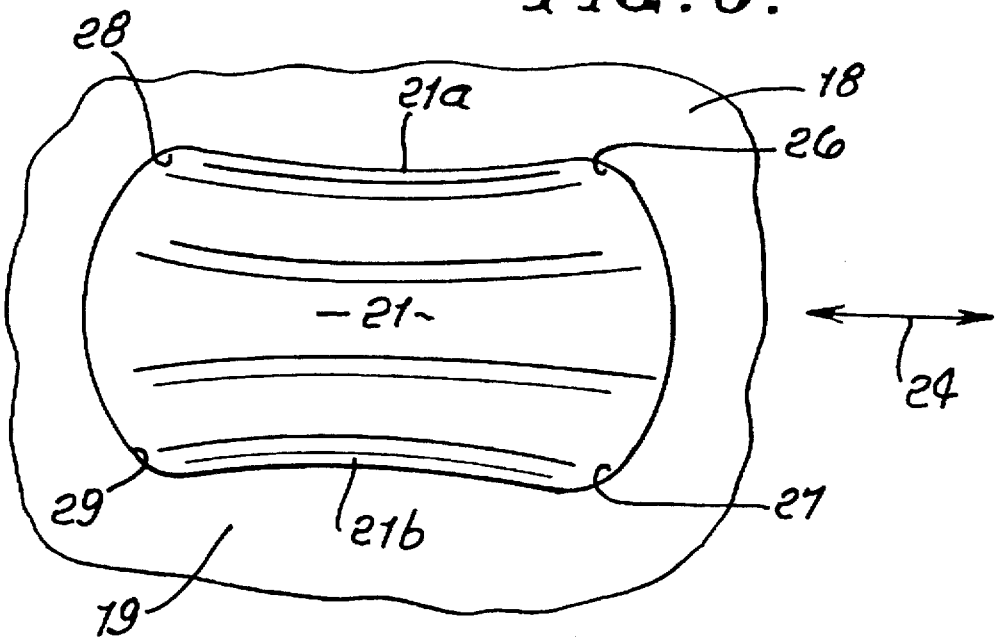
FIG. 5 is a bottom plan view taken on lines 5—5 of FIG. 4.
Figure 6:
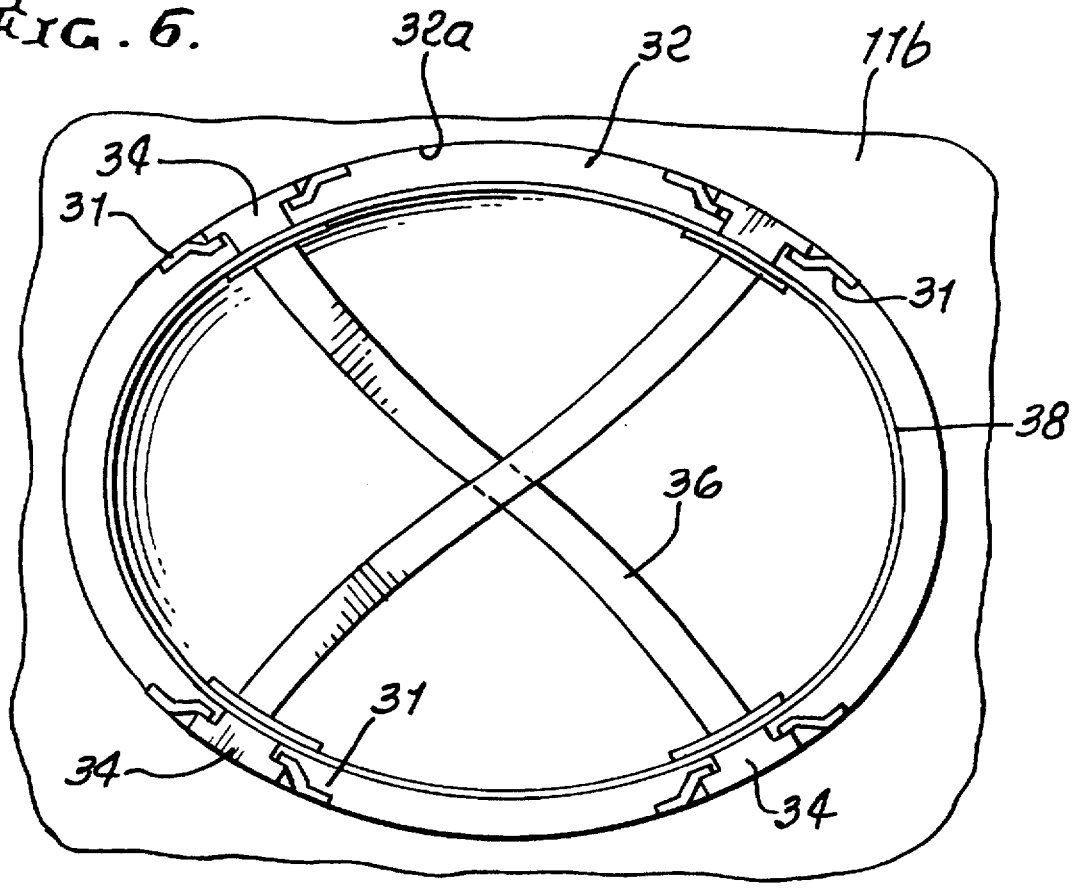
FIG. 6 is an enlarged bottom plan view taken on lines 6—6 of FIG. 1.
Figure 8:
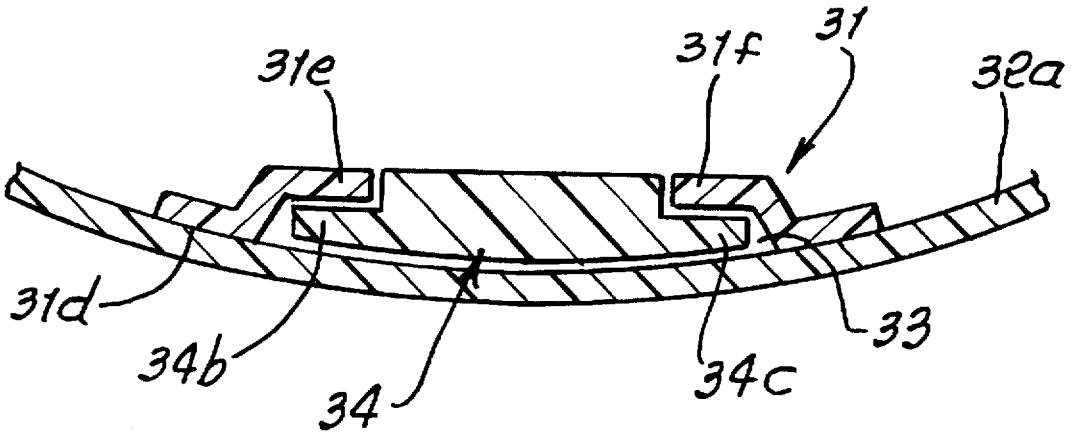
FIG. 8 is a section taken on lines 8—8 of FIG. 7.
Figure 7:
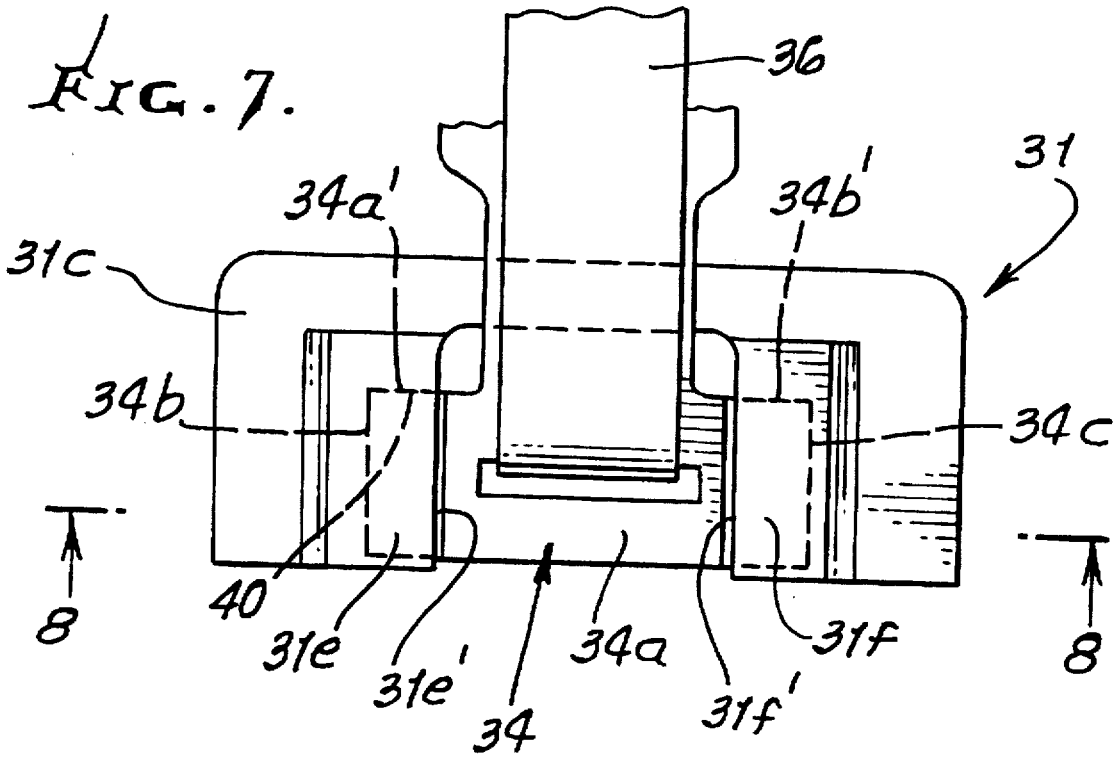
FIG. 7 is an enlarged side elevation showing harness retention structure
Figure 9:
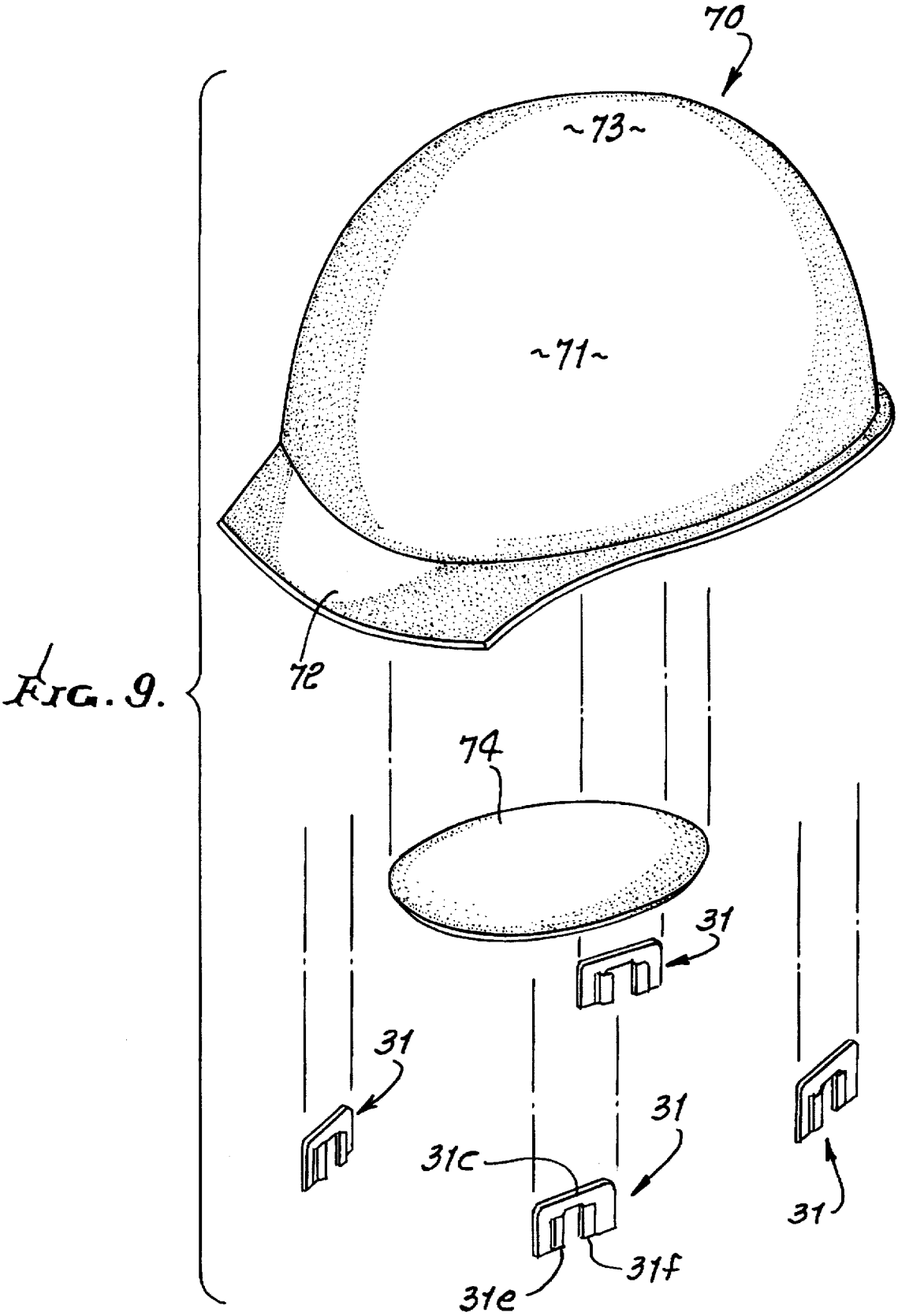
FIG. 9 is an exploded perspective view of a modified hat, incorporating the invention.
Figure 10:
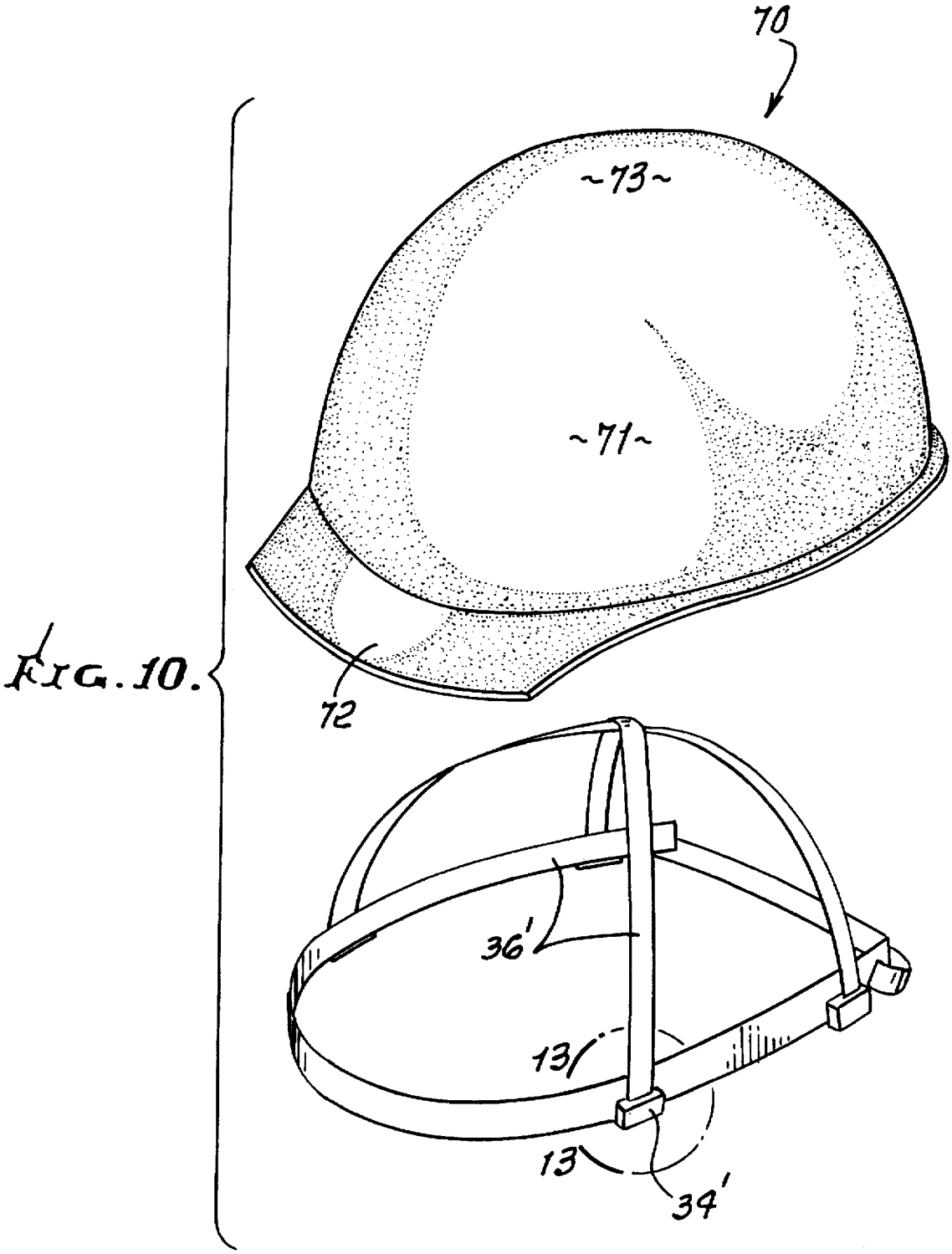
FIG. 10 is a further exploded perspective view of the FIG. 9 hat, and a harness structure.

As shown in FIGS. 4 and 5, the forwardmost edge extent of sub-sheet 21 is forwardly convex, as at corners 26 and 27, and has curvature matching the wall curvature of the hat, at locations where portions 18 and 19 terminate forwardly; and the rearwardmost edge extent of the sub-sheet 21 is rearwardly convex, as at corners 28 and 29, and has curvature matching the wall curvature of the hat portions where 18 and 19 terminate rearwardly. This gives reinforcement to portions 18 and 19 where they turn downwardly. Accordingly, the complex curvature of portions 15, 18 and 19 is adequately reinforced, and the hat itself may have the same overall thin wall thickness adapting it to molding, and breakage at the dome uppermost extent is prevented. These features are applicable to other thin-walled plastic hats having crowns needing reinforcement.

A further feature of the invention concerns the provision of multiple thin-walled carriers 31 for head support harness structure, the carriers molded of plastic material and having thin outer sides bonded to the inner side 32*a* of the lower looping extent 32 of the dome. The sheet-like carriers and the dome inner side 32*a* form slots 33 for upward slide-in retention of the elements 34 of the support harness structure. As shown, the carriers consist of molded plastic material, adapted to be adhesively bonded to the dome inner side 32*a*, avoiding need for rivets or other fasteners.

Each of the four carriers 31 includes a U-shaped body 31*c* having an inner side 31*d* flatly engaging the dome inner side to be bonded to same. Also, each carrier, includes two flat wings 31*e* and 31*f*, offset inwardly away from the plane of the body 31*c* and spaced apart, as shown. This enables formation of the thin slots 33 that frictionally receive insert elements 34, for slide-in reception and retention. This is important for frictional retention in position of the head-engaging bands 36 that extend upwardly in the hat interior to seat on the wearer's head.

Also, elements 34 have tongues 34*a* that fit between edges 31*e*' and 31*f*' of the wings to extend upwardly in the hat interior and carry a plastic looping band 38 that fits about the wearer's head. Elements 34 have wings 34*b* and 34*c* that fit in the slots 33 and have edges 34*a*' and 34*b*' that seat against inner edges 40 of the body 31*c*.

Accordingly, a simple, effective, all plastic hat is provided, with comfortable support on the wearer's head, and which also provides head support harness structure that is easily shiftable into and out of retained position on the carriers.

In FIGS. 9 through 13, the thin-walled, molded plastic sheet hat 70 has a dome 71 that is everywhere concave toward the hat interior. The hat may also have a brim, as at 72. The dome-shaped sheet forms a crown indicated at 73 having an uppermost local portion defining a U-shaped cross section. See FIG. 11. In this case, the U-shape is inverted, to be downwardly concave.

Figure 11:
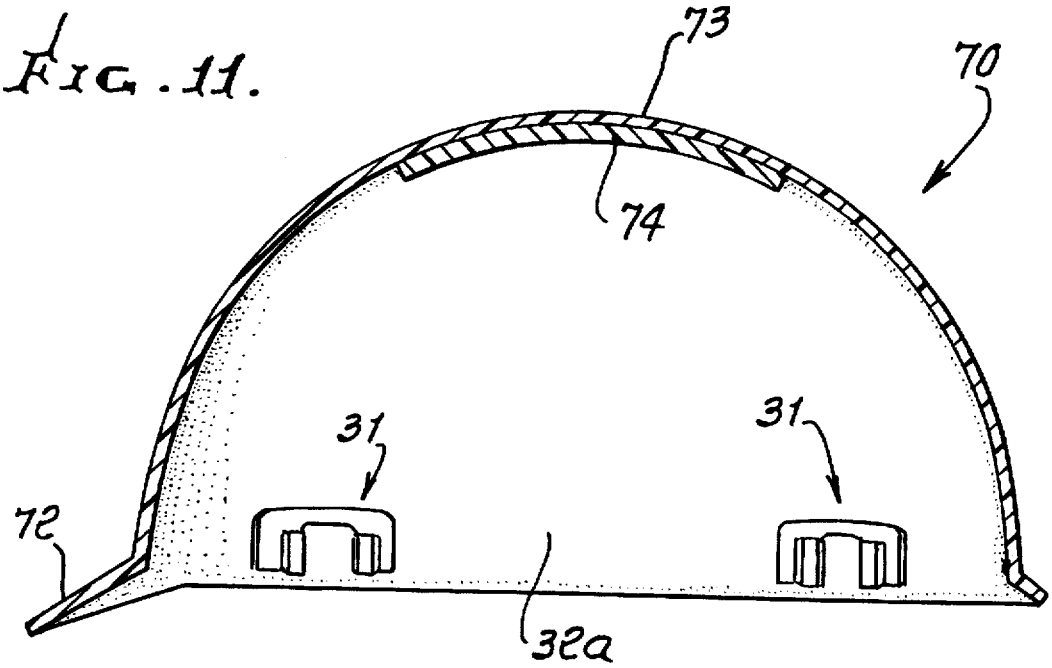
FIG. 11 is a vertical section through the modified hat.
Figure 12:
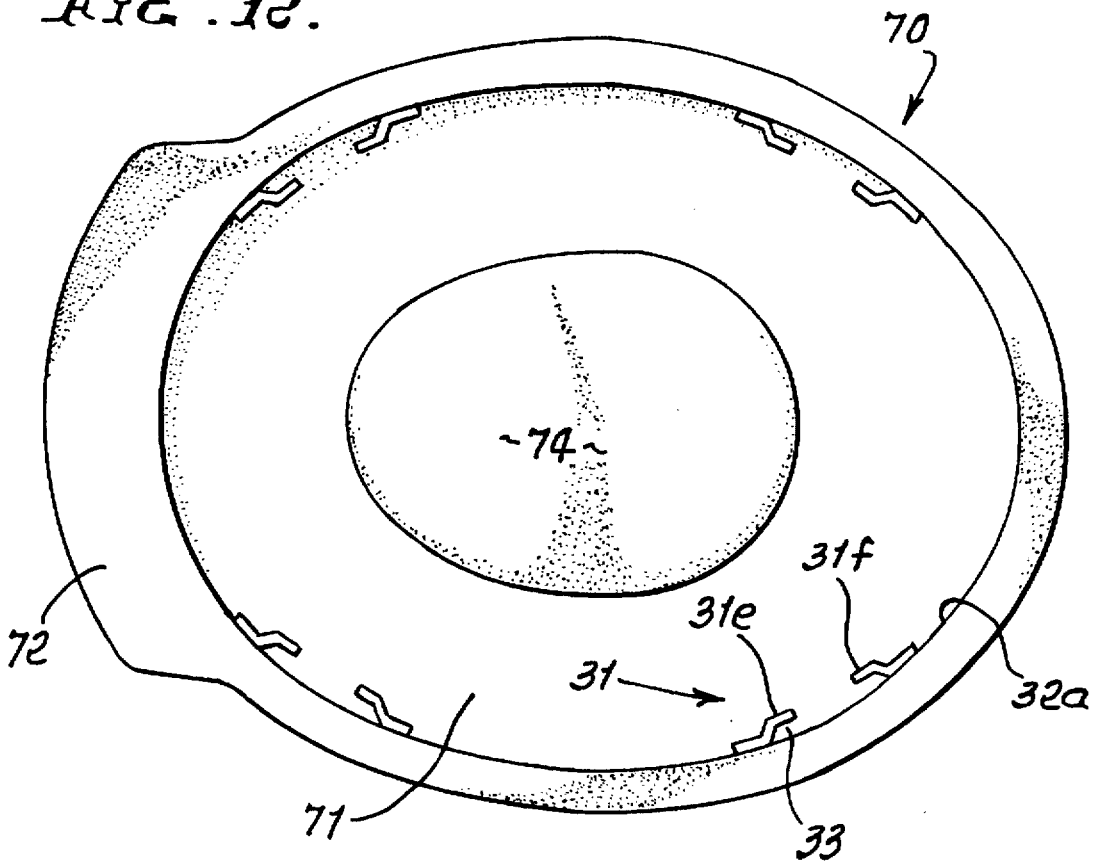
FIG. 12 is a bottom plan view of the modified hat.
Figure 13:
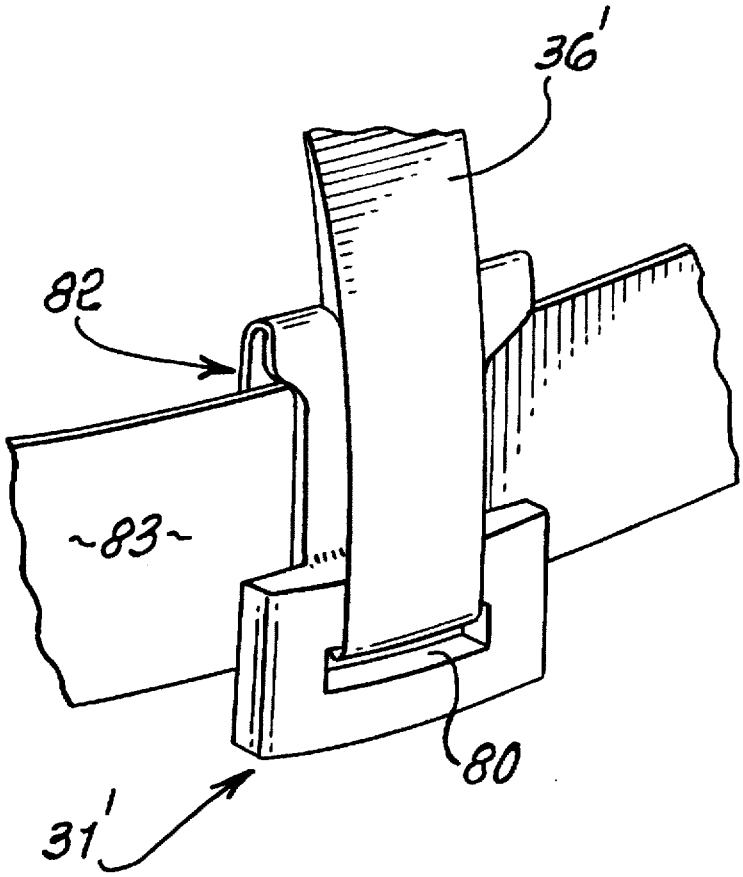
FIG. 13 is an enlarged perspective view taken on lines 13—13 of FIG. 12.

A local plastic sub-sheet 74 is molded to have a U-shaped cross section, as in FIG. 11, and which matches the U-shape of the crown local portion 73. The plastic sub-sheet fits and is adhesively bonded to the underside of local portion 73. Sub-sheet 74 has thickness less than ¼ inch; and the hat itself has thickness less than 3/16 inch. The length of the sub-sheet is between 1 inch and 4 inches.

Ring-shaped carriers 31' are provided to have a central opening 80 to pass a web 36'. Insert elements (not shown) support the carriers, and attach at 82 to the hat structure 83.

The form of the invention shown in FIGS. 1–9 is preferred.

I claim:

1. A one-piece, lightweight, molded plastic hat comprising in combination:

a) a thin, molded plastic sheet material forming a hat dome wall having an inner side, said sheet having a substantially uniform thickness of less than 3/16 inch, b) said hat dome wall having a lower looping portion having an inner side for reception over a wearer's head, said lower looping portion also consisting of said molded plastic sheet material, c) multiple plastic thin-walled carriers bonded to said inner side of said lower looping portion, d) said carriers each having thin sheet configurations and forming wings, e) said carriers and said hat dome wall forming slots for retention of a head-supporting harness structure, f) and including said harness structure having wings retained adjacent to said carrier wings.

2. The combination of claim 1 wherein said carriers have a thickness less than ⅛ inch.

3. The combination of claim 1 wherein each said slot has length, width and thickness dimensions, and wherein said length and width dimensions are substantially greater than said thickness dimension.

4. The combination of claim 1 including said harness structure defining inserts slidably received in said slots.

5. A one-piece, lightweight, molded plastic hat comprising in combination:

a) a thin, molded plastic sheet material forming a hat dome wall having an inner side, said sheet having a substantially uniform thickness of less than 3/16 inch, b) said hat dome wall having a lower looping portion having an inner side for reception over a wearer's head, said lower looping portion also consisting of said molded plastic sheet material, c) multiple plastic thin-walled carriers bonded to said inner side of said lower looping portion, d) said carriers each having thin sheet configurations and forming wings, e) said carriers and said hat dome wall forming slots for retention of a head-supporting harness structure, f) and including said harness structure defining inserts slidably received in said slots, g) and wherein said carriers define wings that are spaced apart, and said inserts define wings retained adjacent to said carrier wings.

6. The combination of claim 5 including harness band structure and wherein a said carrier wings have edges and said inserts have tongues received between said edges of said carrier wings and that carry said harness band structure.

7. The combination of claim 5 wherein said inserts are made of plastic material and have frictionally slidable engagement with said carriers.

* * * * *